US005127322A

United States Patent [19]

Kobler

[11] Patent Number: 5,127,322

[45] Date of Patent: Jul. 7, 1992

[54] PRINTING MACHINE PLATE MOUNTING APPARATUS

[75] Inventor: Ingo Kobler, Anhausen, Fed. Rep. of Germany

[73] Assignee: Man Roland Druckmaschinen AG, Offenbach am Main, Fed. Rep. of Germany

[21] Appl. No.: 596,947

[22] Filed: Oct. 12, 1990

[30] Foreign Application Priority Data

Dec. 7, 1989 [DE] Fed. Rep. of Germany .....3,940,449

[51] Int. Cl.[5] ..... B41F 5/04

[52] U.S. Cl. ..... 101/219; 101/378; 101/415.1; 101/DIG. 36; 901/17

[58] Field of Search ..... 101/DIG. 36, 415.1, 101/378, 52-54, 219; 901/14-17

[56] References Cited

U.S. PATENT DOCUMENTS 4,412,490 11/1983 Grosshauser ..... 101/219
4,623,294 11/1986 Schröder ..... 901/17 x
4,727,807 3/1988 Suzuki et al. ..... 101/415.1

FOREIGN PATENT DOCUMENTS 0100778 2/1984 European Pat. Off. .
2804970 8/1978 Fed. Rep. of Germany .
3239580 4/1984 Fed. Rep. of Germany .
59-165659 9/1984 Japan .
60-73850 4/1985 Japan .
62-19458 1/1987 Japan .
1-176558 7/1989 Japan .

*Primary Examiner*—Edgar S. Burr
*Assistant Examiner*—Christopher A. Bennett
*Attorney, Agent, or Firm*—Frishauf, Holtz, Goodman & Woodward

[57] ABSTRACT

For automating the placement or removal of printing plates on plate cylinders (16, 17) of rotary printing machines, particularly web printing machines, an application head (11) is secured to a multiple linked roboter arm (2), slidable vertically along a guide post (1). The roboter arm can be pivoted about the axis of the guide post, moved vertically thereabout, and includes a plurality of joints (3, 4, 5, 6) which connect roboter arm link elements (7, 8, 9, 10). The positioning head (11) is located at the roboter arm element (10) most remote from the guide post. The guide post is positioned between the axes of rotation of printing cylinders of adjacent printing stations, axially removed from the path of the web between the printing stations, so that interference with the web is effectively avoided.

10 Claims, 2 Drawing Sheets

PRINTING MACHINE PLATE MOUNTING APPARATUS

Reference to related patent, the disclosure of which is hereby incorporated by reference: U.S. Pat. No. 4,727,807, Suzuki et al. Reference to related publication: Japanese Patent 60- 73850, Suzuki et al.

FIELD OF THE INVENTION.

The present invention relates to apparatus for automatically applying a printing plate on a plate cylinder, and especially to apparatus of this type particularly suitable for rotary printing machines.

BACKGROUND.

U.S. Pat. No. 4,727,807, Suzuki et al., the disclosure of which is hereby incorporated by reference, describes an apparatus for automatically mounting, and dismounting or disassembling, printing plates in a rotary printing machine. The apparatus includes a storage magazine for plates, apparatus to remove plates from the printing machine, and placing it in advance of a printing station. A roboter arm carried in a parallelogram guide system and a mechanical hand secured thereto can grasp a printing plate removed from the storage section when the arm is in a backward direction, and applying it on a cylinder when the arm is in a forward direction. The apparatus is secured to a support attached to the floor, or to a printing machine frame. It is not rotatable, and thus can service only a single printing station. The space taken up by the arrangement permits placement of the apparatus only in small rotary printing machines, and especially those which have only a single printing assembly or printing station.

The Japanese Patent 60-73850, by the same inventors as those of the U.S. patent and assigned to the same assignee, describes a system which can be placed on rails secured to the floor or attached to the frame of a printing machine station to attach or disassemble printing plates in rotary printing machines. The mechanical hand is again secured to an arm extending in horizontal direction. The mechanical hand is longitudinally movable and can be adjusted vertically along a vertical spindle. The mechanical hand is rotatable about the axis of the spindle. This arrangement permits selective operation for placing or disassembling printing plates from printing machines of two adjacently located printing stations. The horizontal movability of the system requires, however, a good deal of space.

THE INVENTION.

It is an object to provide a printing machine plate handling system which is capable of applying or removing printing plates on or from plate cylinders of adjacent printing stations without in any way interfering of a web which is guided through the printing stations, or which is impeded by the web which is guided through the printing station.

Briefly, a vertical guide post has a roboter arm located on the guide post. The roboter arm is movable in the direction of the axis of the guide post. A positioning guide is located at the end of the roboter arm, remote from the guide post. The guide post itself is located between the plate cylinders of adjacent printing stations. The roboter arm is pivotable about an axis of the guide post and movable towards either one of the cylinders or out of engagement therefrom. The guide post is located in the plane of the web, as it passes between the printing stations that is, it is so positioned that interference with a printing web between the cylinders is avoided.

In accordance with a feature of the invention, the roboter arm has at least one, and preferably a plurality of links so that portions of the arm can pivot about link axes, extending essentially parallel to the axes of rotation of the respective plate cylinders.

DRAWINGS

DETAILED DESCRIPTION

Figure 1:
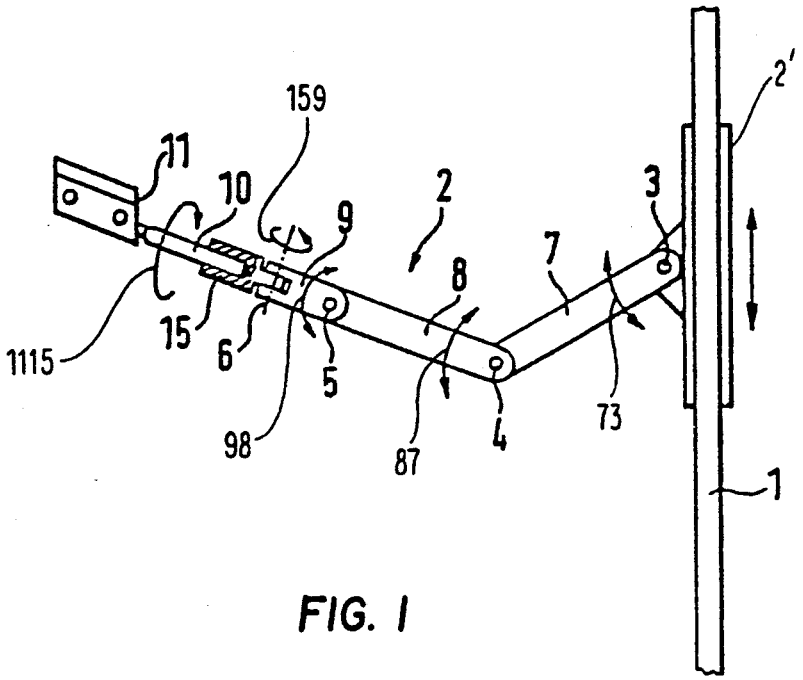
FIG. 1 is a highly schematic side view of the printing plate positioning apparatus.
Figure 2:
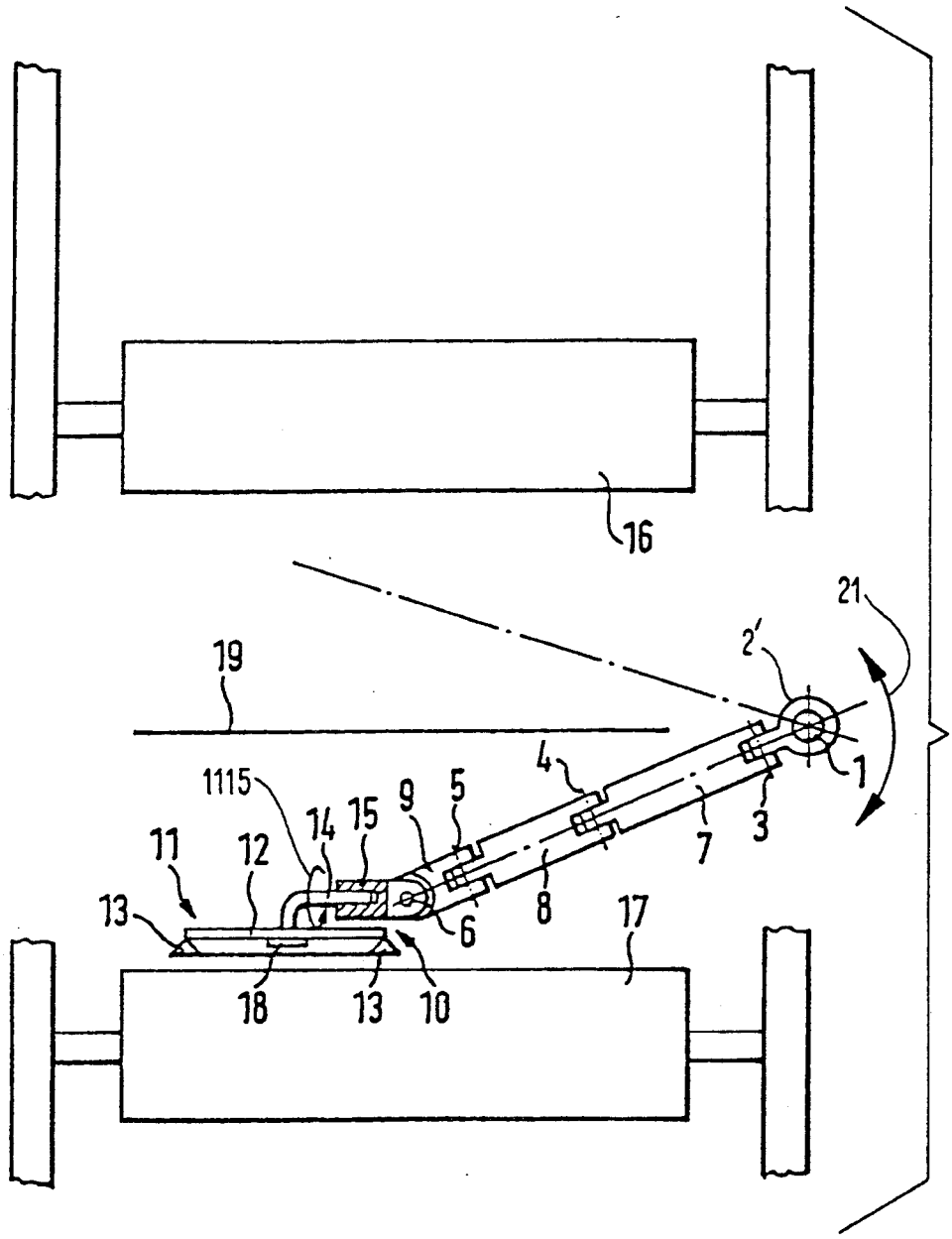
FIG. 2 is a top view of the apparatus shown in FIG. 1, in which the printing plate positioning apparatus is in operative plate supplying or removal position.

Referring first to FIGS. 1 and 2:

A vertical guide post 1 forms a guide or slide way for a roboter arm 2. The roboter arm 2 can be moved up and down along the axis of the guide post 1, and, further, can rotate or pivot about the axis of the guide post 1. A slide, operable vertically, and rotatable about the guide post, carries a bracket with a first pivot 3, permitting vertical movement of a link 7. A second pivot 4 couples the link 7 to a second link 8. Link 8 terminates in a pivot joint 5 to which an attachment link 9 is coupled. Attachment link 9 terminates in a fourth joint 6, to which link element 10 is attached. Link element 10 terminates in a suitable handling head 11, which is the apparatus which actually places a printing plate on a plate cylinder, or is capable of holding the plate to be removed therefrom.

FIG. 2 illustrates that the guide element 2' can pivot about the axis of post 1 in such a way that, with approximately equal angular deflection from the plane of a web 19 between the printing stations having cylinders 16, 17, respectively, the handling head 11 can reach a plate cylinder 17 of a printing station at the left side of the post (FIG. 3) or the plate cylinder 16 of a printing station at the right of the guide post 1. The guide post 1 is so located that, when the roboter arm 2 is in operative position, it does not touch a web 19 which runs between the two printing stations. Guide rollers 19*a*, 19*b* guide the web 19 in a plane in which, also, the post 1 is located (see FIG. 3).

To move the arm 2 from the left plate cylinder 17 towards the right plate cylinder 16, the arm can be moved as a whole into vertical position and, if desired, the first joint 4 can pivot the arm by about 180°, in order to prevent interference between the arm 2 and the web 19, as it swings from facing the plate cylinder 17 towards the position where it will face the plate cylinder 16. Thus, even during the swinging movement, shown by arrow 21 in FIG. 2, no contact with the web 19 will result. The roboter arm 2 is so long that it can reach the plate cylinder even most remote from the vertical post 1, when the arm 2 is stretched or almost stretched out.

The roboter arm 2 has a handling head 11 at its last link position 10. The handling head 11, essentially, includes a suction rod or pipe or plate 12 having suction opening 13 therein. The suction openings 13, by vacuum, hold and grip a printing plate. The head 11 further includes a rotary guide holder 14, which is rotatably located in a sleeve-like arm element 15. An apparatus 18, suitable for applying a plate on the plate cylinders 16, 17, is used to fit the printing plate on the respective plate cylinder 16, 17 or, selectively, remove the printing plate from the plate cylinder. Application and removal of the printing plate from the plate cylinder can be carried out either only by the apparatus 18, or by cooperative elements on the plate cylinder itself. Such an apparatus 18 may, for example, be formed as a mechanical claw. The joint 5 permits placement of the suction rod or plate 12, with the suction openings 13 in horizontal position independently of the position, in space, of the other portions of the arm.

The joint 6 permits placement of the guide rod 14 for application of a plate to the plate cylinders 16, 17, in a direction parallel to the axis of rotation of the respective plate cylinder. The rotationally supported rod 14, and its rotational attachment in the arm element 15 permits matching of the printing plate to the periphery of the respective cylinder 16 or 17.

The movement of the links 7–10 of the roboter arm are hydraulically controlled, as well known. The necessary positioning cylinders, hydraulic lines, attachment elements, hydraulic liquid supplies and the associated control apparatus have not been specifically shown in FIGS. 1–3 for simplification of the drawing. They are well known and can be constructed in accordance with any well known hydraulic positioning systems. A suitable cooperative movement of the links about the joints 3, 4, and 5, as well as rotation of the rod 14 can readily be controlled by remote control, so that the arm is capable of applying a printing plate to a plate cylinder which it faces and with which it is aligned, at least roughly, by the vertical slider 2', sliding guide post 1, and controlled in position, for example, hydraulically, by a rack-and-spindle arrangement or the like.

The apparatus permits application of printing plates to plate cylinders of a printing machine, such as a newspaper rotary printing machine. This is a highly labor-intensive job, which must be carried out, usually, under substantial time pressure, since printing plates are provided to the printer only at the last minute in order to be able to print the latest news. The system permits rapid application of printing plates or, selectively, removal of previously used printing plates for replacement by others, so that at least a portion of the work is automated. This permits a substantial saving in time and highly skilled personnel; more importantly, however, it permits later deadlines for the newspaper publisher.

Figure 3:
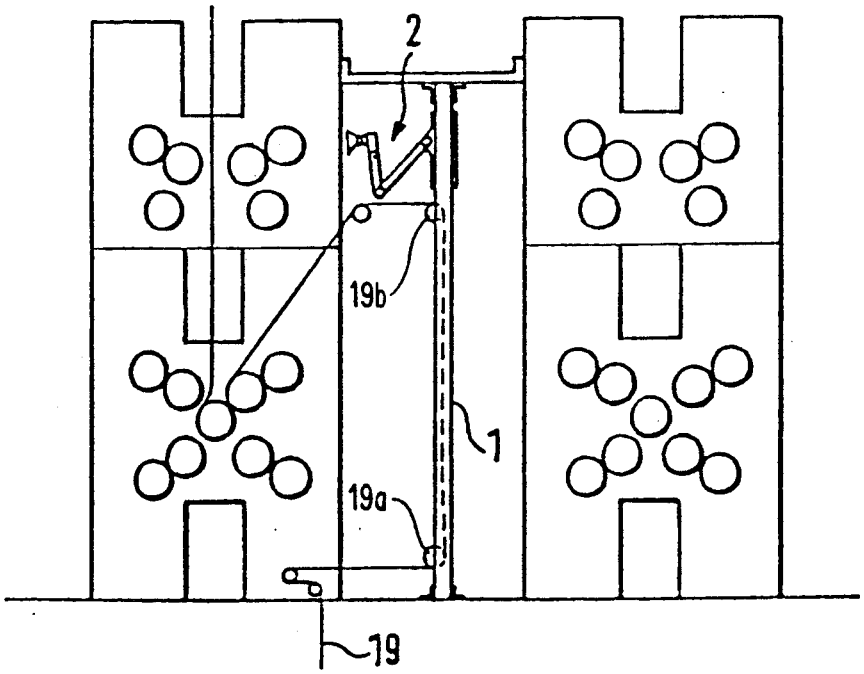
FIG. 3 is a schematic side view illustrating two adjacently located printing stations, and a printing web being guided through one of the printing stations.

FIG. 3 is a highly schematic side view of two adjacent printing stations with a web 19 carried from a lower level to one printing station, towards an upper level, where it can then be guided, for example, downwardly in the right-side printing station. The plate cylinders of the two printing stations can be made ready for printing automatically without in any way interfering with the running of the web by operation, movement or the use of the roboter arm 2.

Suction lines connected to the suction cups or openings 13 have been omitted from the drawing since, likewise, they can be placed as well known in pneumatically operated automatic systems.

The hydraulic positioning elements for the arms 7, 8, 9, 10, 14, since they are well known structures, are shown only schematically by the positioning arrows 73, 87, 98, 159, 1115. These positioning arrows indicate the direction of rotation of the hydraulic positioning elements as well as schematically representing them.

Various changes and modifications may be made within the scope of the inventive concept.

I claim:

1. The combination of a rotary printing machine having spaced printing stations with spaced plate cylinders (16, 17), and web guide means (**19*a*, 19*b*) for guiding a web (19**) of printing substrate between said printing stations, and defining a guide plane;

with a printing plate application and removal apparatus comprising a vertical guide post (1);

a roboter arm (2) having one end thereof located on said guide post and movable in the direction of the axis of the guide post and pivotable about said axis towards either of the cylinders;

a positioning head (11) located at the end of the roboter arm (2) remote from said guide post; and wherein said guide post is located between the axes of rotation of said spaced plate cylinders and on said guide plane, and spaced from the substrate web (19).

2. The apparatus of claim 1, wherein said guide post (1) is located radially beyond an edge of the web (19) passing between said spaced plate cylinders (16, 17).

3. The apparatus of claim 1, wherein said vertical guide post (1) includes a vertically movable guide element (2'); and wherein a first pivot joint (3) is provided, pivotably linking the roboter arm (2) to said movable guide element.

4. The apparatus of claim 1, wherein said roboter arm (2) comprises a plurality of pivot joints (3, 4, 5, 6) and link elements (7, 8, 9, 10) pivoted at said pivot joints.

5. The apparatus of claim 3, wherein said roboter arm comprises a first link element (7) coupled to said first pivot joint (3):

a second link element (8);

a second pivot joint (4) coupling said first and second link elements;

a third link element (9);

a third pivot joint (5) coupling said second and third link elements;

a fourth link element (10); and a fourth pivot joint (6) coupling said third and fourth link elements.

6. The apparatus of claim 4, wherein said positioning head (11) is coupled to that one of the arm link elements most remote from the guide post (1).

7. The apparatus of claim 5, wherein the positioning head (11) is coupled to the fourth link element (10).

8. The apparatus of claim 1, wherein the positioning head includes means (18) for, selectively, attaching a printing plate on a printing cylinder, or removing a printing plate from the plate cylinder (16, 17).

9. The apparatus of claim 4, further including hydraulic operating means (73, 87, 98, 159, 1115) coupled to said link elements for positioning the link elements, selectively, relative to each other, said guide post (1) and said positioning head (11).

10. The apparatus of claim 5, further including hydraulic operating means (73, 87, 98, 159, 1115) coupled to said link elements for positioning the link elements, selectively, relative to each other, said guide post (1) and said positioning head (11).

* * * * *